US008132834B2

(12) United States Patent
Buhagiar

(10) Patent No.: US 8,132,834 B2
(45) Date of Patent: Mar. 13, 2012

(54) ANIMAL WASTE DISPOSAL TOOL

(76) Inventor: Jordan Buhagiar, Davis, CA (US)

( * ) Notice: Subject to any disclaimer, the term of this patent is extended or adjusted under 35 U.S.C. 154(b) by 643 days.

(21) Appl. No.: 12/136,309

(22) Filed: Jun. 10, 2008

(65) Prior Publication Data

US 2009/0302625 A1 Dec. 10, 2009

(51) Int. Cl.
*A01K 29/00* (2006.01)

(52) U.S. Cl. ..... 294/1.4; 294/50.5

(58) Field of Classification Search ..... 294/1.4, 294/50.9, 61; 15/257.01, 257.1, 104.001
See application file for complete search history.

(56) References Cited

U.S. PATENT DOCUMENTS

| | | | | |
|---|---|---|---|---|
| 658,831 | A | 10/1900 | Danielsen | |
| 2,800,354 | A * | 7/1957 | King | 294/61 |
| 2,804,336 | A * | 8/1957 | Thompson | 294/61 |
| 4,019,768 | A | 4/1977 | Niece | |
| 4,032,182 | A | 6/1977 | D'Ath | |
| 4,102,547 | A | 7/1978 | Williams | |
| 4,148,513 | A * | 4/1979 | Gagne | 294/1.4 |
| 4,200,321 | A * | 4/1980 | Warkentin | 294/1.4 |
| 4,316,627 | A * | 2/1982 | Solypa | 294/1.4 |
| 4,368,907 | A * | 1/1983 | Ross | 294/1.4 |
| 4,846,286 | A * | 7/1989 | McNeely et al. | 172/379 |
| 5,370,433 | A * | 12/1994 | Yost | 294/50.5 |
| 5,562,318 | A | 10/1996 | McBroom | |
| 5,564,267 | A * | 10/1996 | Bricker et al. | 56/400.12 |
| 5,667,264 | A | 9/1997 | Tanahara | |
| 5,788,299 | A * | 8/1998 | Wilkinson | 294/51 |
| 6,349,776 | B1 * | 2/2002 | Hus | 172/375 |
| 6,554,334 | B2 | 4/2003 | Rincon Uribe | |
| 6,634,163 | B2 * | 10/2003 | Kill | 56/400.08 |
| 2005/0082854 | A1 | 4/2005 | Barr | |

FOREIGN PATENT DOCUMENTS

| | | | |
|---|---|---|---|
| GB | WO 93/06307 | A1 | 4/1993 |
| WO | WO/2008/024069 | A1 | 2/2008 |

* cited by examiner

*Primary Examiner* — Saul Rodriguez
*Assistant Examiner* — Stephen Vu
(74) *Attorney, Agent, or Firm* — Edward S. Sherman

(57) ABSTRACT

A tool for retrieving animal waste is effective in complete removal as it deploys at its end a row of tines that are inserted beneath the solid waste so that is can be lifted from the ground as the first step for proper disposal. The waste is then removed from the tines by a plate that pushes it off into a waste receptacle.

20 Claims, 9 Drawing Sheets

FIG. 1A
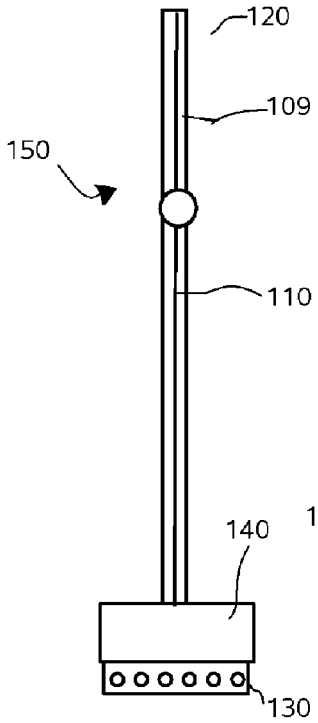
FIG. 1B
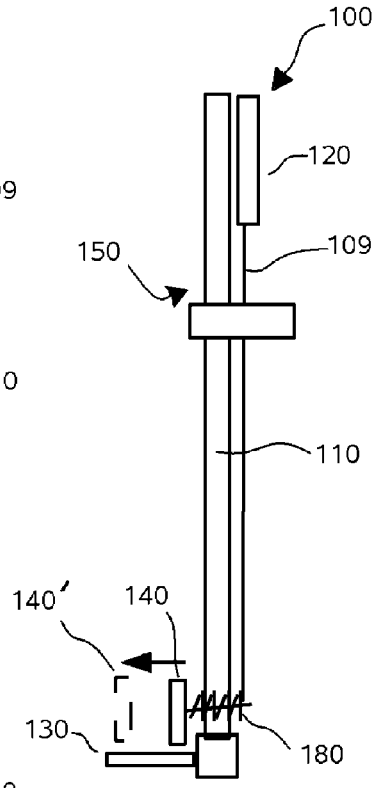
FIG. 1C
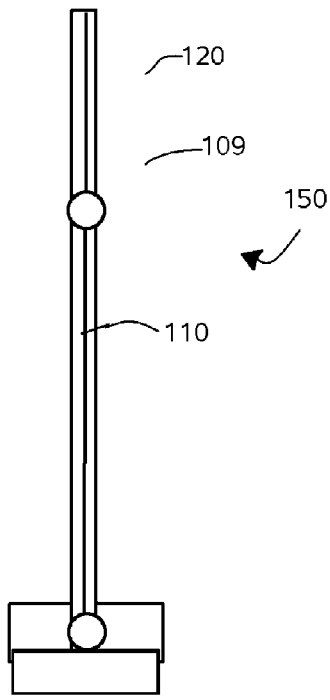
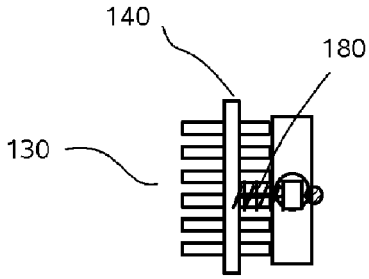
FIG. 1D

FIG. 2A
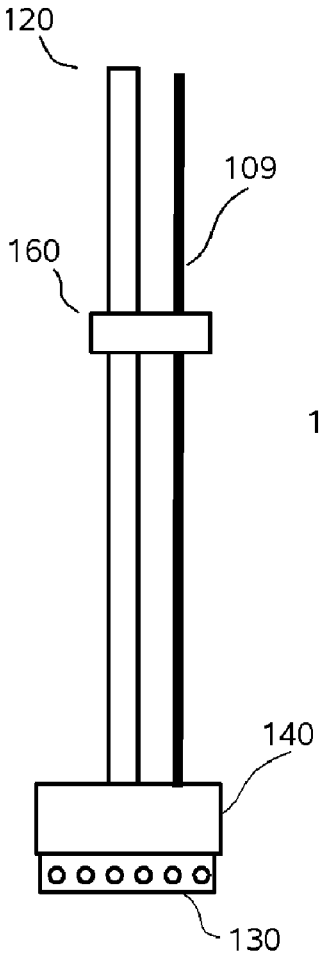
FIG. 2B
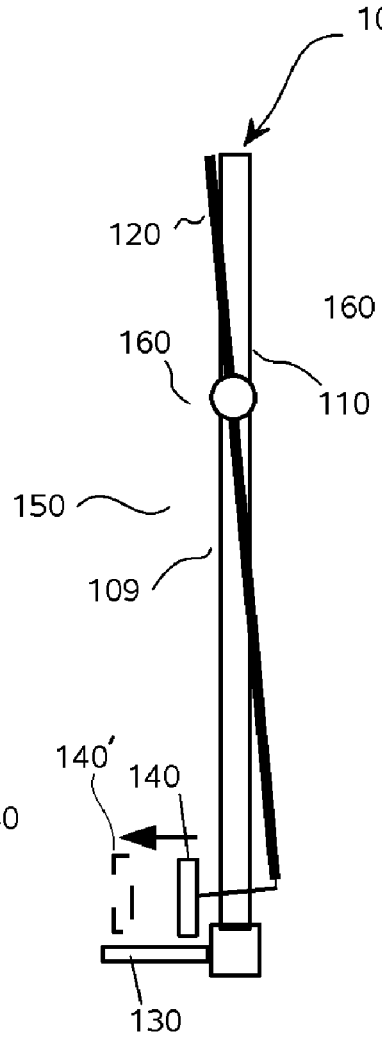
FIG. 2C
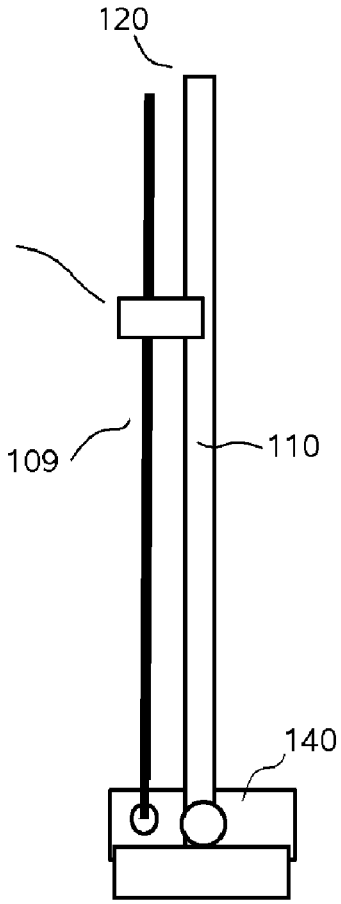
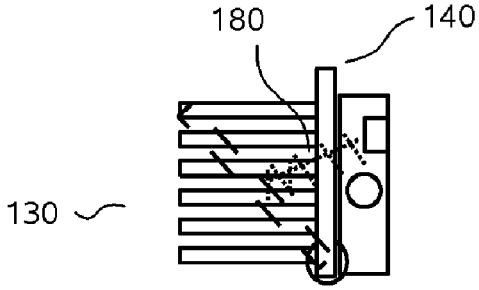
FIG. 2D

FIG. 3A
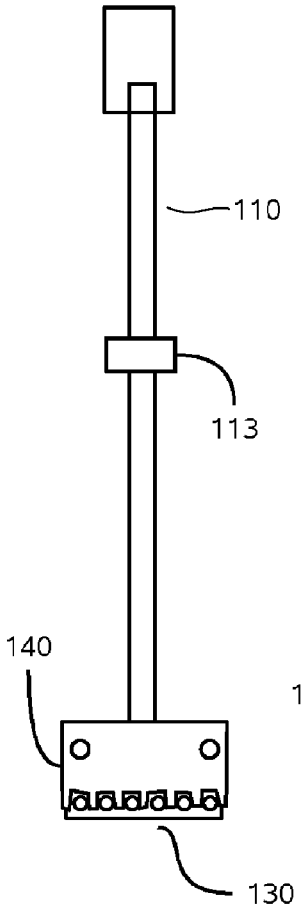
FIG. 3B
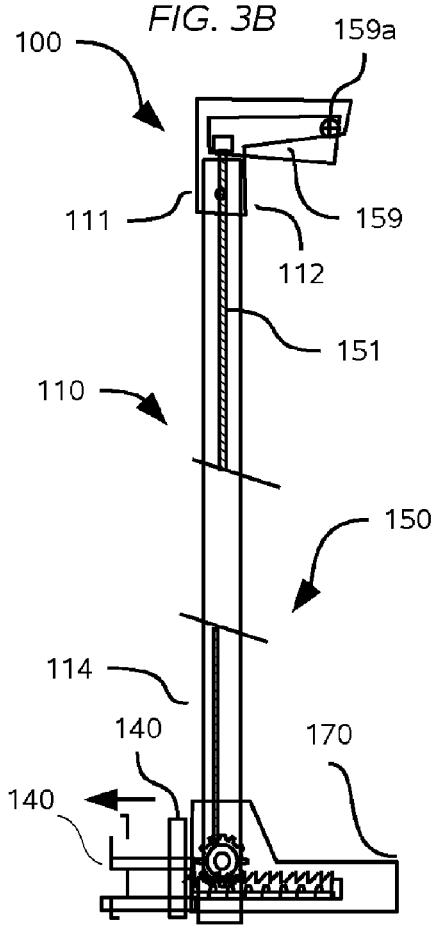
FIG. 3C
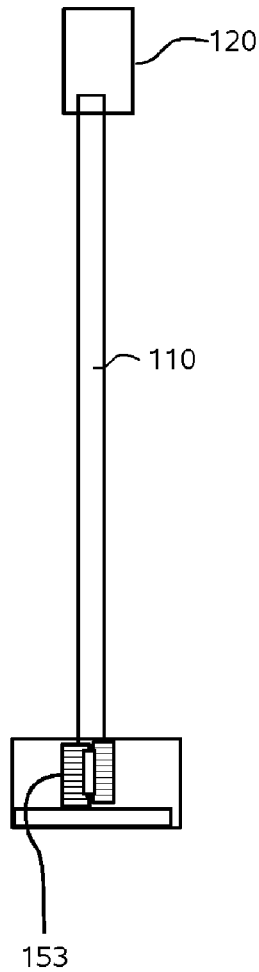
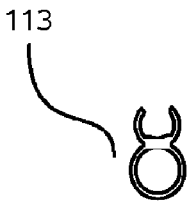
FIG. 3E
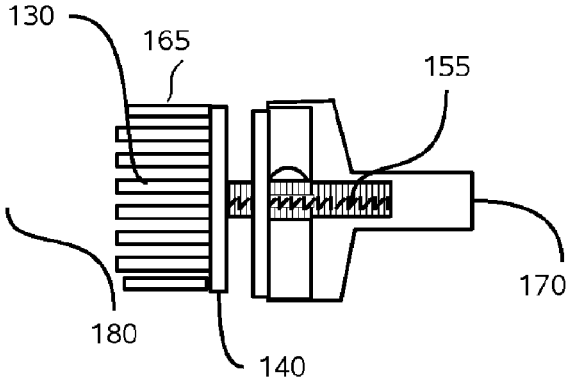
FIG. 3D FIG. 6A
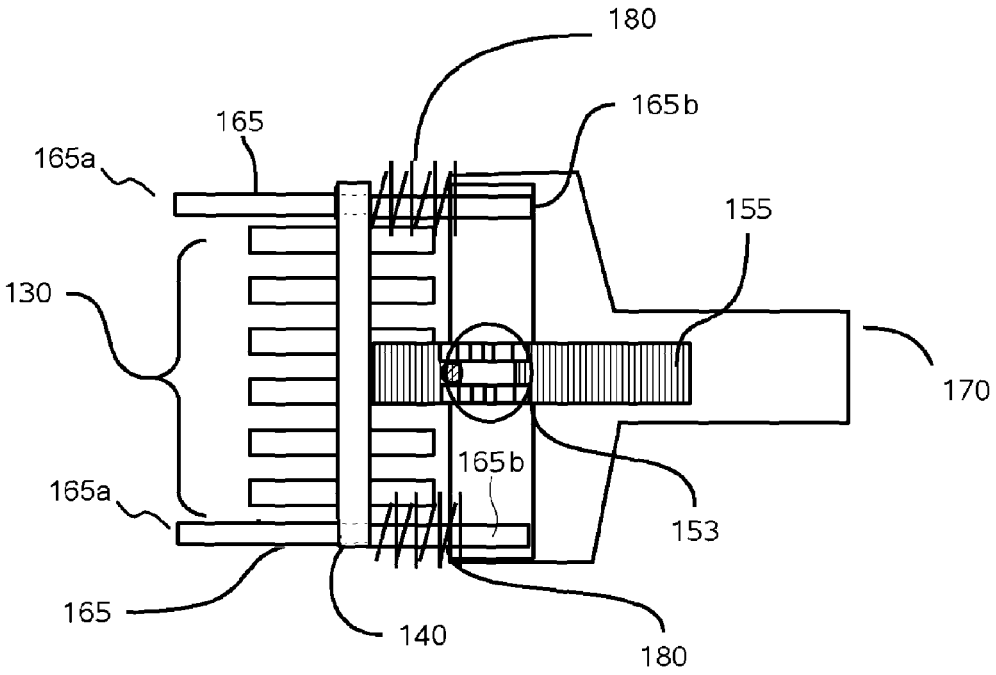
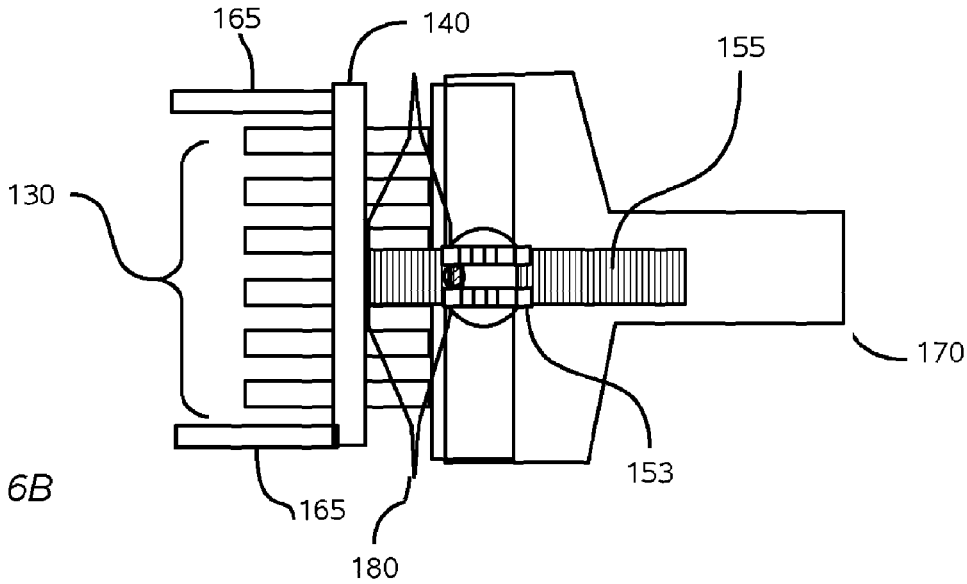
FIG. 6B FIG. 7A
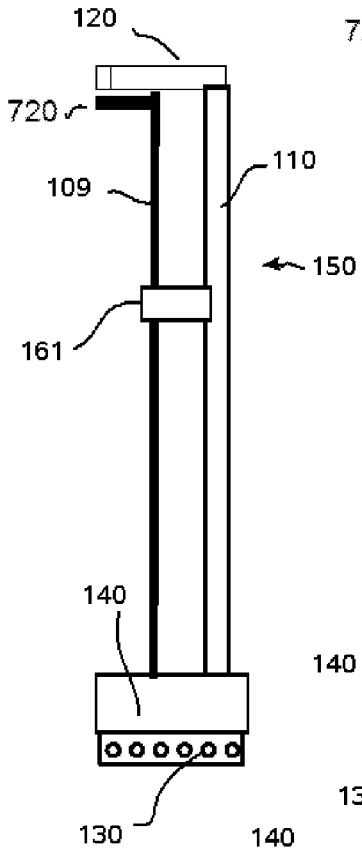
FIG. 7B
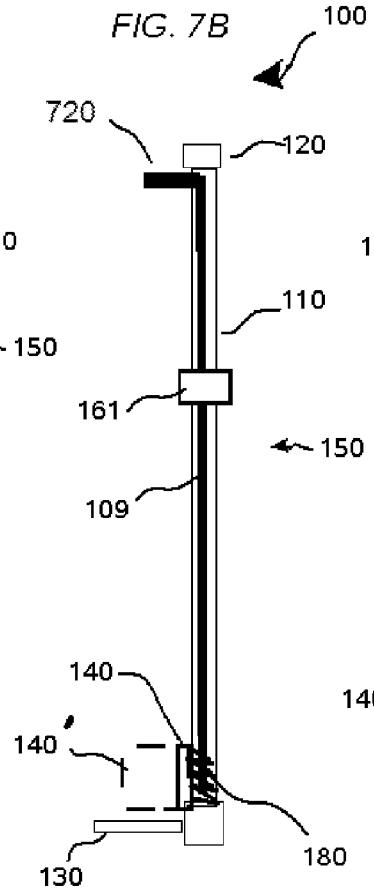
FIG. 7C
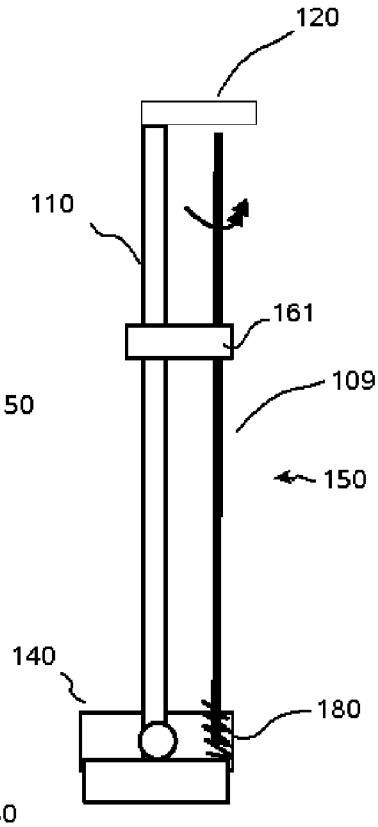
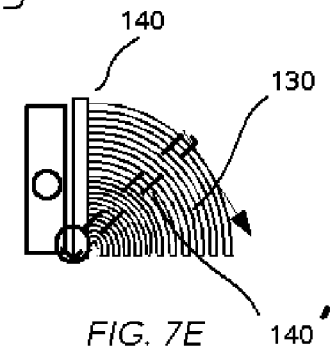
FIG. 7E
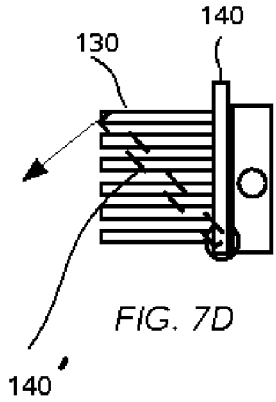
FIG. 7D

ANIMAL WASTE DISPOSAL TOOL

CROSS REFERENCE TO RELATED APPLICATIONS

None

BACKGROUND OF INVENTION

The present invention relates to a device for animal waste disposal

It is desirable and frequently required by law that pet owners promptly remove pet dropping from public parks and sidewalks, as well as from private property, for health reasons, as well as the damage it does to grass and other vegetation.

As many pet owners do not wish to bend over and use papers or plastic bags to remove droppings by hand an array of devices have been developed.

However, many of these prior art device are deficient are deficient in one manner or another as will be discussed below. Virtually all prior art devices attempt to provide a more sanitary means of removing pet waste, that is to avoid contact. Some these prior art devices use one of more scoops o shovel shapes to capture the waste. Frequently, these prior art devices tend to either incompletely remove droppings, or if used to completely remove the dropping also require the removal of surrounding grass and soil, and are hence also injurious to landscaping.

Further, these devices also tend to collect animal waste residue, and hence require regular cleaning and additional maintenance.

If the tools are used move aggressively to remove all residues, more residues tend to stick to the tool. Further, the tool portion that contacts the waste can be difficult to clean.

Accordingly it is a first object of the invention to provide an improved means to remove animal droppings, and particular pet droppings wherein the user/handler need not stoop over.

It is yet another object of the invention to provide such an improved apparatus that can completely remove such animal waste, yet will not damage grass or ground cover.

It is still a further object of the invention to provide such a device having the above attributes, that while capable of completely removing such animal droppings of varying consistency, will not become soiled or clogged and will hence be easier to clean and maintain.

SUMMARY OF INVENTION

In the present invention, the first and other objects are achieved by providing a method of removing animal waste, the method comprising the steps of: providing a tool having a lateral lifting surface at one end, a plate disposed over said lifting surface for sweeping waste off the lifting surface when loaded thereon, wherein the lifting surface and plate are disposed at the end of a shaft, inserting the lifting surface under the waste to be removed, lifting the shaft upward to remove the waste from the ground, transporting the waste to a disposal container, translating the plate over the lifting surface to urge the waste there from whereby it falls in the disposal container.

In a second aspect of the invention other objects are achieved by providing a tool for animal waste removal, the tool comprising: a shaft having a top and a bottom, a handle at top of shaft, a lateral lifting surface disposed in a first common plane, said first common plan being substantially horizontal to and coupled to the bottom of said shaft, a plate disposed perpendicular and immediately above said plurality of tines, an actuator coupling said handle to said plate wherein the operation of said actuator via said handle urges said plate to move in said first common plane perpendicular to said lateral lifting surface.

In a third aspect of the invention other objects are achieved by providing a tool for animal waste removal, the tool comprising a shaft having a top and a bottom, a handle at top of shaft, a plurality of tines disposed in a first common plane, said first common plan being substantially horizontal to and coupled to the bottom of said shaft, a plate disposed perpendicular and immediately above said plurality of tines, an actuator coupling said handle to said plate wherein the operation of said actuator via said handle urges said plate to move in said first common plane perpendicular to said plurality of tines.

The above and other objects, effects, features, and advantages of the present invention will become more apparent from the following description of the embodiments thereof taken in conjunction with the accompanying drawings.

BRIEF DESCRIPTION OF THE DRAWINGS

FIG. 1A-C are schematic elevations of the front, side and rear respectively of a first embodiment of the invention, while FIG. 1D is a plan view thereof.

FIG. 2A-C are schematic elevations of the front, side and rear respectively of a second embodiment of the invention, while FIG. 2D is a plan view thereof.

FIG. 3A-C are schematic elevations of the front, side and rear respectively of a third embodiment of the invention, while FIG. 3D is a plan view.

FIG. 3E is a plan view of the clip shown in FIG. 3A at section line E-E.

FIG. 6A is a plan view of an alternative embodiment of the moving plate portion.

FIG. 6B is a plan view of another alternative embodiment of the moving plate portion.

FIG. 7A-C are schematic elevations of the front, side and rear respectively of a fourth embodiment of the invention, while FIG. 7D is a plan view thereof. FIG. 7E is an alternative embodiment of the portion shown in FIG. 7D.

FIGS. 8A and 8B illustrate an alternative embodiment of an actuator, in which FIG. 8A is a perspective view of the lower portion of the device from slightly above the side and FIG. 8B is a cut away perspective view of a portion of the interior mechanism of the actuator from slightly above and behind the lower portion of the device.

DETAILED DESCRIPTION

Figure 4:
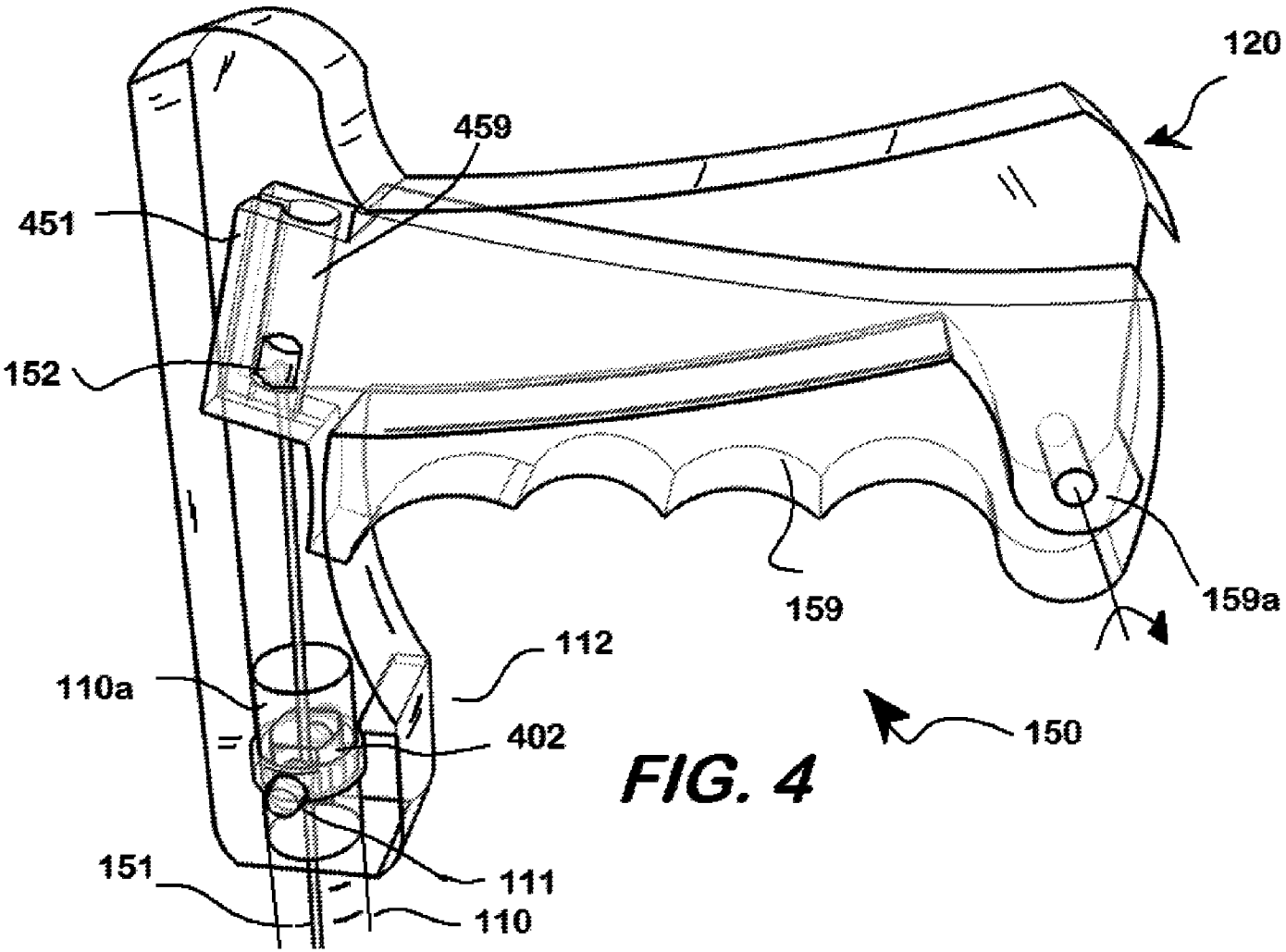
FIG. 4 is a perspective view of the interior of the actuator mechanism at the handle trigger end.

Referring to FIGS. 1 through 8, wherein like reference numerals refer to like components in the various views, there is illustrated therein a new and improved Animal Waste Disposal Tool, generally denominated 100 herein.

In accordance with a first embodiment of the present invention, FIG. 1 illustrates tool 100 having a shaft 110 having a top 110*a* and a bottom 110*b*, with a handle 120 generally disposed toward the top of shaft 110. At the opposing or bottom end 110*b* of shaft 110 a plurality of tines 130 are disposed in a first common plane 131, said first common plane being substantially horizontal to and coupled to the bottom of said shaft. A plate 140 is disposed perpendicular and immediately above the plurality of tines 130

An actuator 150 coupling the handle 120 to plate 140 wherein the operation of said actuator 150 via said handle 120 urges said plate 140 to move in the common plane perpendicular to the plurality of tines 130. Plate 140 is shown in alternative position in broken lines and labeled 140' in the Figures.

It should be understood that is more preferable that each of the embodiments also comprises a spring biasing mechanism 180, such as leaf spring(s) coils springs and torsion springs and the like, as shown in FIGS. 6A and 6B, as well as FIG. 7. In particular, it is preferably a torsion spring when plate 140 rotates about or adjacent to shaft 110 in FIG. 5. The spring 180 preferably supplies a constant and controlled minimum force to eject waste off the tines 130.

As shown in FIG. 1, the actuator mechanism 150 alternatives include a rotating bar connecting the plate to the handle, as well as a bar that slides in and out, each extending from the plate to the top of the shaft. The top of this bar is the handle. The bar can be connecting to the shaft at some intermediate position by a slide or pivot mechanism. The slide or pivot can include a biasing means. Actuator may include a cable actuator and/or a coupling to magnify the plate displacement with respect to the handle displacement. Alternative actuator mechanisms can be any found in the prior art search.

The tines 130, being spaced apart with gaps is readily inserted under the waste matter without while slide through blades or grass and other vegetative matter. Accordingly, when the operator lifts the tool 100 upward, they pick up the waste but also do not damage the grass as it ready slips through the tines. Dispose.

Accordingly, it will now be appreciated that the device 100 improves sanitation and hygiene by complete removal without residue on the ground as animal waste can be removed without direct contact. Further, the user of the device need not stoop over to remove waste, nor carry, buy or find plastic bags is general purpose waste receptacle are in the general vicinity. The tine arrangement minimizes the potential for leaving waste residue on the tool, as the contact therewith is minimizes and not pressure is asserted to squeeze the waste onto the tool other than its own mass. Likewise, as the plate 140 slides across the tines 130, and will readily remove the waste there from without leaving significant residue. Further, the tool 100 portions, which is the tines 130 and the plate 140 that contacts residue, are easy to clean.

In FIG. 1 the actuator 150 deploys another or secondary shaft 109 coupled at the bottom to the plate 140 and at the top to the handle 120. The secondary shaft 109 and slides laterally with respect to the main supporting shaft 110, remaining parallel thereto. Various combinations of spring 180 elements shown in other embodiments can be used to bias the plate 140 to either alternative position. Further, the secondary shaft 109 is optionally supported at the center as shown, but more preferably at both the top and bottom by slots or channel that extend from the main shaft 110, so that it is restrained to move laterally.

In FIG. 2 the actuator 150 is another or secondary shaft 109 coupled at the bottom to the plate 140 and at the top to the handle 120. The secondary shaft 109 pivots about the center of the main supporting shaft 110, via a rotary coupling 160, thus the movement of handle 120 forward, retracts plate 140, while the backward movement propels it forward along with plate 140 to push waste matter off the tines 130. Various combinations of spring 180 elements shown in other embodiments can be used to bias the plate 140 to either alternative position. The spring 180 elements can be at either the plate 140 end, the handle end 140 or a torsion spring in the rotary coupling 160.

FIG. 3 illustrates a more preferred embodiment that further comprises rails 165 that extend above and parallel to the plurality of tines 130. In various other embodiments the rails 165 also help stabilize the plate 140, acting as plate guides. However, the primary function is to insure that waste cannot fall or slip sideways off the tines 140 was it is lifted off the ground. Preferably, the plate 140 has a lower portion with fingers that are inter-digitated to extend into the gaps between the tines 130.

In the embodiment of FIG. 3, the actuator mechanism 150 comprises a cable 151 that is responsive to squeezing the trigger 159 portion of handle 120. The cable 151 terminates at the upper portion with a capping cylinder 152, shown in more detail in FIG. 4 in a transparent perspective view. The capping cylinder 152 and the top portion of the cable 151 are inserted into the opposite end of the trigger 159 (distal from rotary coupling 159*a*) which has with a downward oriented bore hole 459 and a side slit 451 that extends laterally to reach the entire length of the bore hole 459. The bore hole 459. has an upper portion that is wide enough to retain the capping cylinder 152. This upper portion is followed by a lower portion that is just wider than the cable, but narrower than the capping cylinder; so that when the cable is inserted in the slot and pulled downward (or the block pulled upward) the capping cylinder 152 will be retained in this bore hole 459 in the trigger 159.

Figure 5:
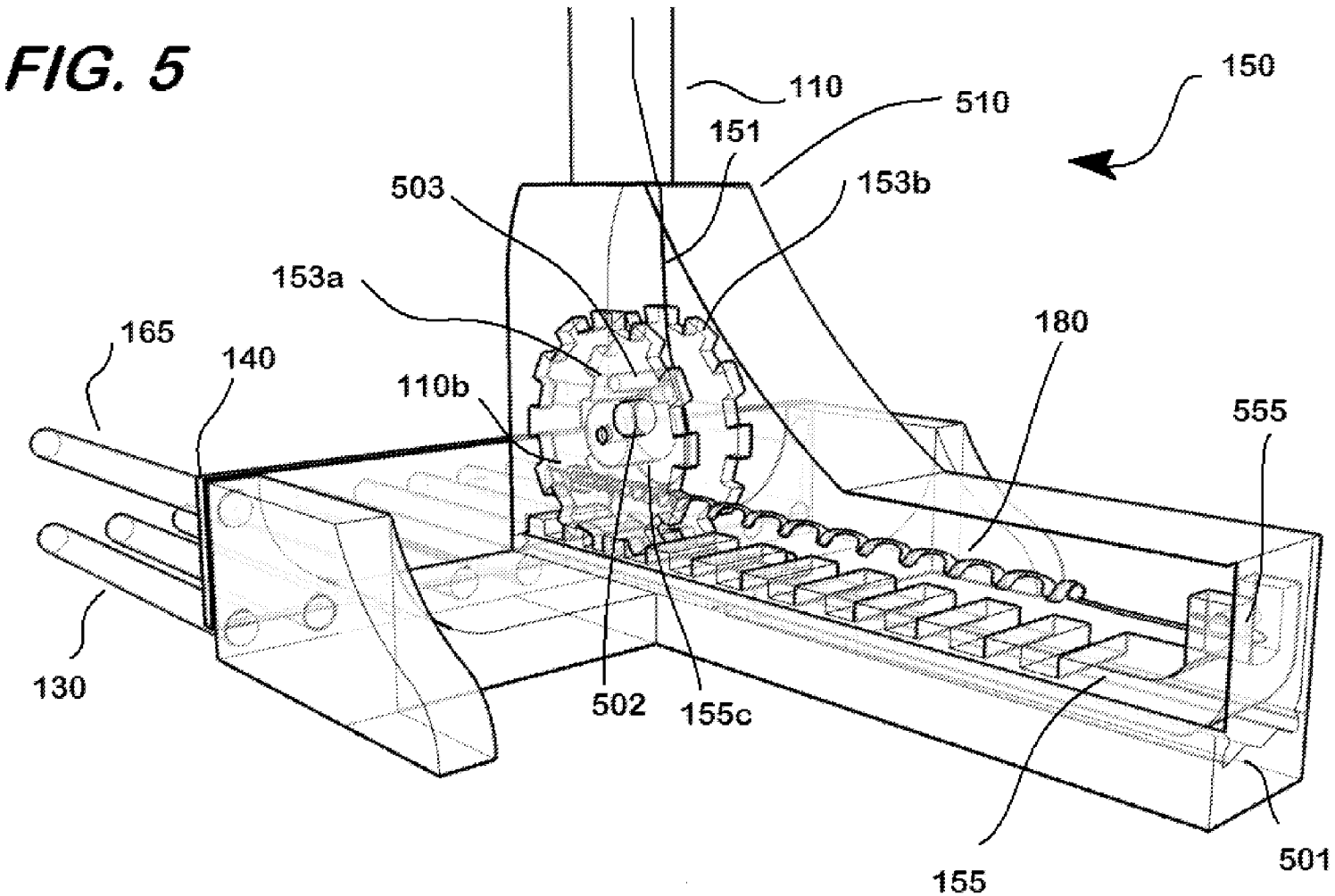
FIG. 5 is a perspective view of the interior of the actuator mechanism at the bottom of the shaft with the tines and moving plate.

As shown in detail in FIG. 5, the opposite end of the cable 151 at the base of shaft 110, that is side 110*b*, is connected in rotary engagement with a round gear 153 that is divided into two axially separated portions which are round gears 153*a* and 153*b*. The intervening axle 155*c* is thus driven by the cable 151 via the grip handle trigger 159. The trigger 159 mechanism has a rotary coupling 159*a* at the end of the hand grip so that when it is squeezed and pulled backward into the handle the cable 151 is pulled upward. Then, at the opposite end of the actuator 150, the cable 151 rotates the round gear 153 and urges the plate 140 backward, thus compressing the spring 180.

The cable 151 is physically attached to the intervening axial 155*c*. Further, at least one of the round step gears 153*a* and 153*b* has an off center external projection 502 on its outside that is intended to engage a similar projection 503 extending inward from the case 510, and thus limit the range of rotary motion of the round gear 153 to the intended travel range of the cable 151.

Each of the axially separated round step gears 153*a* and 153*b* simultaneously engage tracks of flat gear 155. By flat gear we mean the arrangement of gear teeth in a linear coplanar arrangement. The portion of the flat gear 155 most distal from plate 140 has a vertical portion 555 for supporting a spring 180. The end of spring 180 distal from plate 140 is connected toward the top of this vertical portion. The flat gear 155 fits and slides in the rectangular well in the base having a series of tracks 501 in the bottom that are in a triangular shape, making limited contact with the reverse side of the flat gear, opposite the teeth thereof, to minimize friction. However, these are merely the currently preferred embodiments of the flat gear and well, which need not have the shapes or contact areas shown, as other shapes such as circular, oval and trapezoidal are possible. The spring 180 that biases the plate 140 with respect to the bottom 110*b* of the shaft 110 extends above and in the same direction as the track gear, being below the intervening axle 155*c*, and thus in the gap between the round gears 153*a* and 153*b*.

The proximal end of the flat gear 155 is connected to the reverse side of plate 140, which is the side facing shaft 110. The proximal end of the spring 180 is connected or coupled to the base near the bottom 110*b* of shaft 110. The base thus has an aperture so that the flat gear can translated forward and backward as the actuator 150 is engaged.

Further, the handle 120 rotates for left and right handled operation, preferably includes a locking pin 111 in the shaft 110, as the handle has an axial extension 112 that surrounds the upper portion 110*a* of shaft 110, a common lateral locking pin 111 extends through a pair of common lateral holes to prevent the handle 120 from sliding on shaft 110. The locking pin 111 in spring 402 biased detent mechanism that prevent the handle extension portion 112 from rotating with respect to shaft 110 until it is depressed. Locking pin 111 also enable handle 120 to rotate 180 degrees for left and right handled operation. A clip 113 on shaft 110 for holding the shaft on an associated pan with handle. Preferably, but not exclusively, plate 140 moves in the direction of the tines 140 principle axis 145.

As shown in FIG. 5, spring 180 is normally biased to urge the plate 140 toward the end of the tines 130. Then, when the trigger 159 is squeezed and pulled back into the handle, the upward movement of the cable 151 will rotate the round gear 153 thus, causing the plate 140 to move inward from the end of the tines 130 back toward the case 510. It should be appreciated that another alternative embodiment is attaching a spring to the farthest right side of housing of the case 510 to the vertical extension 555 which will bias the plate 140 and flat gear 155 back into the case 510. Then, when the trigger 159 is squeezed and pulled back into the handle, the upward movement of the cable 151 will rotate the round gear 153 thus, causing the plate 140 to move outward to the end of the tines 130.

Alternatively, as shown in embodiment of FIGS. 7D and 7E, the tines 130 are optionally linear or curved respectively, curves tines being preferable when the plate 140 rotates rather than translates in a complete lateral fashion.

In FIG. 6A, guide rails 165 are shown as also having rearward extending appendages 165*b* to plate 140, spaced above tines 130 attached to side 110*b* of the shaft 110. More preferably, a spring 180 is coiled around each guide rail appendage 165*b*, which are behind plate 140 to avoid fouling. Further, the ends 165*a* of guide rails 165*b* extend through mating holes in the base about shaft side 110*b*, and thus stabilize plate 140. FIG. 6B illustrates one alternative embodiment for using a leaf spring 180, as opposed to ordinary coil springs 180 and 180' in FIG. 6A. While leaf spring 180 is oriented with the wide side vertical, it is also possible to deploy leaf springs of other shapes and orientation. Note that the guide rails 165 are attached to the front of plate 140, moving forward therewith. This alternative embodiment can be used with any of the actuator embodiments described herein.

FIG. 7A-C are schematic elevations of the front, side and rear of a fourth embodiment of the invention, and secondary shaft 109 attached to edge of the plate 140 via a vertical rotary coupling 161. Thus the upper portion of the secondary shaft 109 preferably includes a horizontally extending handle 720 that together with the handle 120 essentially form a trigger mechanism for actuator 150. The plate 140 translates in the plane of the tines by rotating across the tines 130.

In FIG. 7D, which is an alternative embodiment of the portion shown in FIG. 7C, the tines 130 are curved following the curving track of plate 140. It should be apparent that this configuration of curved tines 130 may also be preferable to use with the actuator embodiment shown in FIG. 2. Further, in any of the embodiment the tines 130 and guide rails 165 may have cross sectional shape is optionally round, square, inverted triangles (point up), or flattened or oval. Further, plurality of tines 140 can be replaced with a large flat rectangle lifting plate having the same dimensions, although this would be less desirable for removing animal excrement from grass surface. The plate 140 can move from the handle side of the tine array 130 to the tip thereof in response to the actuator 150, or in the opposite direction so that the rest position of the plate is either at the edge of the tines or at the connection between the tines and the shaft.

Figure 8A:
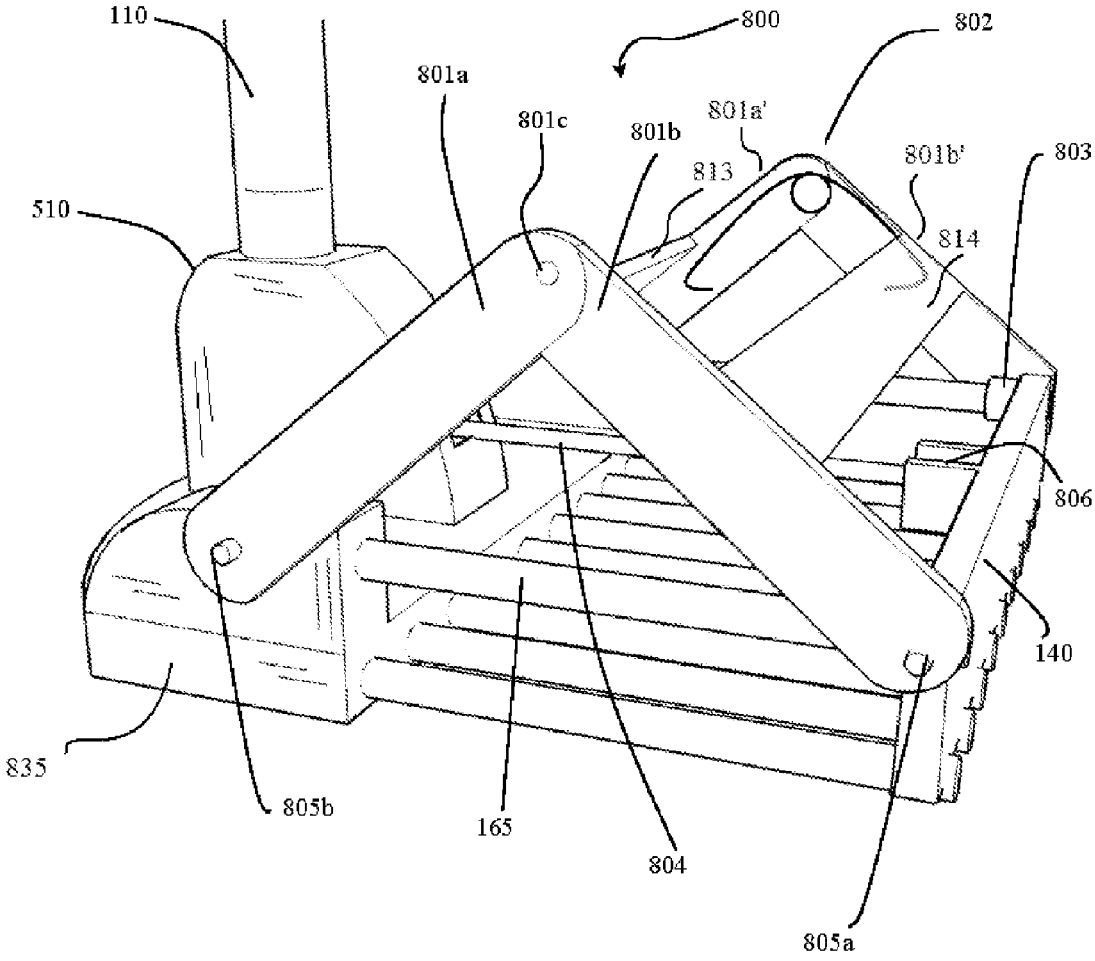
Figure 8B:
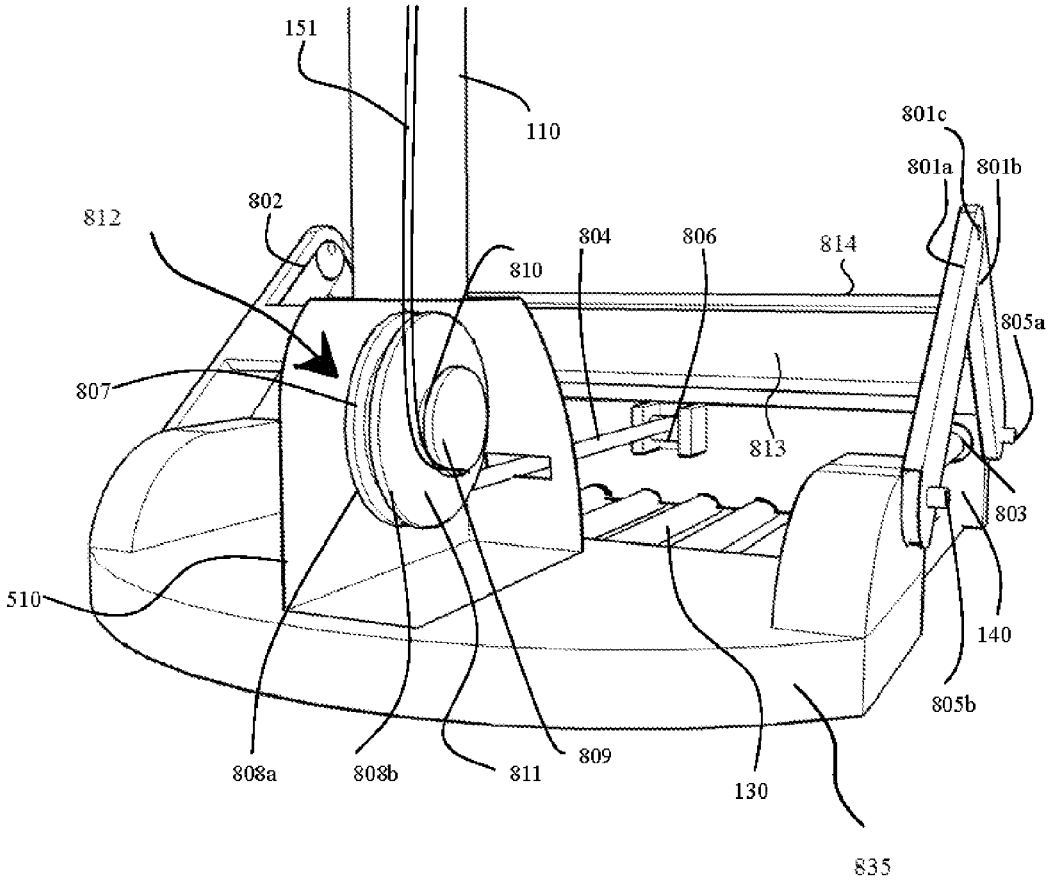

FIGS. 8A and 8B illustrate an alternative embodiment for a lower portion of the actuator wherein the portion thereof coupled to the flat plate 140 deploys pairs of hinged arms 801*a* and 801*b* that unfold to translate the plate 140 across the tines 130. The pairs of hinged arms 801*a* and 801*b* on one side of tine array 130 are connected by cross members 813 and 814 to the pairs of hinged arms 801'*a* and 801'*b* on the opposite side of the tine array. Arms 801*a* and 801*b* are connected in rotary engagement by a pin 801*a*, as are hinged arms 801*a'* and 801*b'*

In FIG. 8A, the opposite end of each hinge arm 801*b* is connected the near side of plate 140 in rotary engagement via another pin 805*a*, with arm 801*a'* likewise connected to the opposite side of plate 140 via another rotary pin connection.

The opposite side of hinge arm 801*b* and 801*b'* are connected to the near and far sides of the wide base 835 in rotary engagement via pins 805*b*. The base 835 is orthogonal to shaft 110 and has about the same width as plate 140.

The plate 140 has two guide rail sleeves 803 located at opposite ends which enable the plate to slide along the guide rails 165. Pairs of torsion spring 802 are coupled to the interior walls of hinge arms 801*a* and 801*b* to bias the rotation there between at pin 801*c* and 801*c'*, normally urging the plate 140 toward the end of the tines 130.

As shown in detail in FIG. 8B, a pulley 812 is connected in rotary engagement at the base of shaft 110. The opposite end of the cable 151 that is attached to the trigger 159 is attached to the axle 810 of pulley 812. Attached to the outer wall of axle 810 is a cable guide 809 that will prevent the cable 151 from slipping off. A second cable 804 is wrapped around protruding post 806 for attachment to the plate 140. The opposite end of the cable 804 is attached to a second axle 807, which has co-axial cable guide 808*a* and 808*b* to prevent the cable 804 from slipping off laterally. The intervening axle 810 is thus driven by the cable 151 via the grip handle trigger 159. The trigger 159 mechanism has a rotary coupling 159*a* at the end of the hand grip so that when it is squeezed and pulled backward into the handle the cable 151 is pulled upward. Then, at the opposite end of the actuator 800, the cable 151 rotates the pulley 812 and urges the plate 140 backwards, via the second cable 804 that is attached to the plate 140, thus compressing the spring 802.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims. For example, it should be appreciated that alternative embodiments also include combination of mechanisms shown in one embodiment with those shown in another.

The invention claimed is:

1. A method of removing animal waste, the method comprising the steps of:

a) providing a tool having a lateral lifting surface at one end, a plate disposed over said lifting surface for sweeping waste off the lifting surface when loaded thereon, wherein the lifting surface and plate are disposed at the bottom of a shaft that has a top and a bottom, wherein the lifting surface is a plurality of spaced apart tines, b) inserting the lifting surface under the waste to be removed, c) lifting the shaft upward to remove the waste from the ground, d) transporting the waste to a disposal container, e) translating the plate over the lifting surface to urge the waste there from whereby it falls in the disposal container.

2. The method of removing animal waste according to claim 1, wherein the plate is translated by a spring biased actuator.

3. The method of removing animal waste according to claim 1 wherein the tool further comprises:

a) a handle on top of the shaft, b) in which the spaced apart tines are disposed in a first common plane, and substantially horizontal and coupled to the bottom of the shaft that extends substantially vertically upward from the first common plane, c) wherein at least a portion of the plate is disposed immediately above said plurality of tines, d) an actuator coupling said handle to said plate wherein the operation of said actuator via said handle urges said plate to move in said first common plane substantially sweeping over said plurality of tines.

4. The method of removing animal waste according to claim 3, wherein said plate further comprises a lower portion that has an interdigitated contoured lower edge that extends around at least a portion of the tines in said plurality of tines.

5. The method of removing animal waste according to claim 4, wherein the actuator comprises a pair of hinged arms that unfold to translate the plate across the tines.

6. The method of removing animal waste according to claim 3, wherein said actuator further comprises a spring to bias the plate to a lateral position when the handle does not engage the actuator.

7. The method of removing animal waste according to claim 6, wherein energy stored in said spring urges the plate forward to remove waste from the tines when the actuator is not engaged.

8. The method of removing animal waste according to claim 3, wherein the actuator rotates said plate in the first common plane.

9. The method of removing animal waste according to claim 8, wherein the tines have a curvilinear shape.

10. The method of removing animal waste according to claim 3, wherein the tool further comprises a pair of guide rails disposed at opposite sides of the plurality of tines that extend in the direction of the movement of said plate, the guide rails being disposed above the first common plane, the guide rails being coupled to at least one of said plate and the bottom of the shaft.

11. The method of removing animal waste according to claim 10, wherein the guide rails are coupled to the bottom of the shaft and extend through mating holes in said plate as said plate is moved in response to said actuator.

12. The method of removing animal waste according to claim 10, wherein said plate further comprises a lower portion that has an interdigitated contoured lower edge that extends around at least a portion of the tines in said plurality of tines.

13. The method of removing animal waste according to claim 1, wherein the spaced apart tines are straight.

14. The method of removing animal waste according to claim 1, wherein the spaced apart tines have a circular cross-section.

15. A method of removing animal waste, the method comprising the steps of:

a) providing a tool having a lateral lifting surface at one end, a plate disposed over said lifting surface for sweeping waste off the lifting surface when loaded thereon, wherein the lifting surface and plate are disposed at the bottom of a shaft that has a top and a bottom, b) inserting the lifting surface under the waste to be removed, c) lifting the shaft upward to remove the waste from the ground, d) transporting the waste to a disposal container, e) translating the plate over the lifting surface to urge the waste there from whereby it falls in the disposal container, f) wherein the plate is translated over the lifting surface by an actuator comprising;

i. a cable, ii. a first and second rotary coupling in rotary engagement via connection to opposite ends of the cable, iii. an actuating handle coupled to turn the first rotary coupling, iv. a gear coupled to the second rotary coupling, v. a spring coupled to the gear coupling, vi. wherein the handle causes the rotation of the first rotary coupling and the plate is urged forward via the gear coupled to the second rotary coupling and said spring is coupled to the gear to resist the rotation of the second rotary coupling.

16. The method of removing animal waste according to claim 15, wherein the lifting surface is a plurality of spaced apart tines.

17. The method of removing animal waste according to claim 16, wherein the tool further comprises a pair of guide rails, wherein each of the guide rails being disposed above the tines that are disposed at side edges of the plate in order to preclude waste from falling off sides of the tines.

18. The method of removing animal waste according to claim 15 wherein the second rotary coupling has gear teeth and the gear is a flat gear track coupled to the plate to engage the gear teeth of the second rotary coupling.

19. A method of removing animal waste, the method comprising the steps of:

a) providing a tool having a lateral lifting surface at one end, a plate disposed over said lifting surface for sweeping waste off the lifting surface when loaded thereon, wherein the lifting surface and plate are disposed at the bottom of a shaft that has a top and a bottom, b) inserting the lifting surface under the waste to be removed, c) lifting the shaft upward to remove the waste from the ground, d) transporting the waste to a disposal container, e) translating the plate over the lifting surface to urge the waste there from whereby it falls in the disposal container, f) wherein the plate is translated by an actuating means comprising a pair of hinged arms that unfold to translate the plate across the lifting surface.

20. The method of removing animal waste according to claim 19, wherein the actuating means is at least one torsion spring is coupled to an arm that is hinged at a rotary connection thereof.

* * * * *